US008980512B2

(12) United States Patent
Kawasaki et al.

(10) Patent No.: US 8,980,512 B2
(45) Date of Patent: Mar. 17, 2015

(54) ELECTROPHOTOGRAPHIC PHOTORECEPTOR, AND METHOD FOR PRODUCING ELECTROPHOTOGRAPHIC PHOTORECEPTOR

(71) Applicants: Yoshiaki Kawasaki, Shizuoka (JP); Hongguo Li, Shizuoka (JP); Tomohiro Hirade, Shizuoka (JP)

(72) Inventors: Yoshiaki Kawasaki, Shizuoka (JP); Hongguo Li, Shizuoka (JP); Tomohiro Hirade, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 31 days.

(21) Appl. No.: 13/863,633

(22) Filed: Apr. 16, 2013

(65) Prior Publication Data

US 2013/0330663 A1 Dec. 12, 2013

(30) Foreign Application Priority Data

Jun. 6, 2012 (JP) ..... 2012-128490
Mar. 8, 2013 (JP) ..... 2013-046190

(51) Int. Cl.
*G03G 5/00* (2006.01)
*G03G 5/043* (2006.01)
*G03G 5/10* (2006.01)

(52) U.S. Cl.
CPC ..... *G03G 5/043* (2013.01); *G03G 5/10* (2013.01); *G03G 5/104* (2013.01); *G03G 5/105* (2013.01)
USPC ..... 430/69; 430/127

(58) Field of Classification Search
CPC ..... G03G 5/105
USPC ..... 430/69, 127
See application file for complete search history.

(56) References Cited

U.S. PATENT DOCUMENTS

| | | | | |
|---|---|---|---|---|
| 4,837,120 | A | 6/1989 | Akiyoshi et al. | |
| 7,531,277 | B1 | 5/2009 | Facci | |
| 2009/0129816 | A1* | 5/2009 | Facci | 399/159 |
| 2009/0162761 | A1 | 6/2009 | Law et al. | |
| 2009/0162777 | A1 | 6/2009 | Law | |
| 2010/0239966 | A1 | 9/2010 | Tong et al. | |

FOREIGN PATENT DOCUMENTS

| | | |
|---|---|---|
| EP | 1 903 401 A2 | 3/2008 |
| JP | 58-030764 | 2/1983 |
| JP | 63-128354 | 5/1988 |
| JP | 2000-143978 | 5/2000 |
| JP | 2002-162764 | 6/2002 |
| JP | 2003-176402 | 6/2003 |
| JP | 2004-013137 | 1/2004 |
| JP | 2004-347903 | 12/2004 |

OTHER PUBLICATIONS

Extended European Search Report issued Sep. 4, 2013, in European Patent Application No. 13166286.8.

* cited by examiner

*Primary Examiner* — Mark A Chapman
(74) *Attorney, Agent, or Firm* — Oblon, McClelland, Maier & Neustadt, L.L.P.

(57) ABSTRACT

An electrophotographic photoreceptor is disclosed. The electrophotographic photoreceptor includes a resin substrate including a carbon nanotube; and a photosensitive layer located overlying the substrate. In addition, a method for producing an electrophotographic photoreceptor is disclosed. The method includes forming a resin substrate by molding a resin forming material including a carbon nanotube; and forming a photosensitive layer overlying the resin substrate.

8 Claims, 1 Drawing Sheet

ELECTROPHOTOGRAPHIC PHOTORECEPTOR, AND METHOD FOR PRODUCING ELECTROPHOTOGRAPHIC PHOTORECEPTOR

CROSS-REFERENCE TO RELATED APPLICATIONS

This patent application is based on and claims priority pursuant to 35 U.S.C. §119 to Japanese Patent Applications Nos. 2012-128490 and 2013-046190, filed on Jun. 6, 2012 and Mar. 8, 2013, respectively, in the Japan Patent Office, the entire disclosure of which is hereby incorporated by reference herein.

FIELD OF THE INVENTION

The present invention relates to an electrophotographic photoreceptor, and a method for producing an electrophotographic photoreceptor.

BACKGROUND OF THE INVENTION

Organic photoreceptors (OPCs) have the following advantages over other photoreceptors:

(1) good optical properties such that the light absorption wavelength range is wide, and light absorbance is high;

(2) good electric properties such that the optical sensitivity is high, and the charge property is stable;

(3) wide material selectivity such that the constituents thereof can be selected from various materials;

(4) good productivity;

(5) low costs; and (6) low toxicity.

Therefore, organic photoreceptors have been broadly used for copiers, facsimiles, printers, and multifunctional products having two or more of copying, facsimileing and printing functions.

Recently, a need exists for miniaturized image forming apparatus, and the size of image forming apparatus becomes smaller and smaller. Therefore, the diameter of the photoreceptors used for such image forming apparatus also becomes smaller and smaller. In addition, since a need exists for high speed and maintenance-free image forming apparatus, photoreceptors having good durability are desired. Specifically, a need exists for a photoreceptor, which has a good combination of abrasion resistance, scratch resistance and electric property and which can produce high quality images over a long period of time. It is known that a protective layer including a filler or a protective layer crosslinked by light or heat is used as an outermost layer of a photoreceptor to enhance the abrasion resistance and scratch resistance of the photoreceptor. In addition, the material used for a substrate of a photoreceptor preferably has good mechanical strength to prevent occurrence of a problem (scratch/indentation problem) in that scratch or indentation is formed on the substrate in a photoreceptor production process or a maintenance operation of the photoreceptor due to handling errors. At the present time, aluminum alloys have been broadly used for substrates of photoreceptors because of having light weight and high electroconductivity while having a good combination of mechanical strength and processability.

However, substrates made of such an aluminum alloy tend to easily cause the above-mentioned scratch/indentation problem and form dent. In addition, substrates preferably have good dimension stability to stably produce high quality images. Therefore, precision machining (such as precision cutting of surface of such substrates) is preferably performed on the substrates. In this case, the production costs of the substrates increase. In addition, manufacturing such aluminum alloys takes a huge amount of energy, and therefore the amount of emitted $CO_2$ is very large. Recently, from the environmental viewpoint, reduction of $CO_2$ emission is desired. Therefore, it is preferable to produce a substrate while reducing $CO_2$ emission. In attempting to solve the problems of such aluminum alloys, electroconductive resin substrates have been proposed. Such resin substrates have a light weight, and in addition by including a filler therein, a good mechanical strength can be imparted thereto, thereby making it possible to produce a substrate for photoreceptors, which has good resistance to scratch, indentation and dent. In addition, since manufacturing such resin substrates dramatically reduces $CO_2$ emission, the resin substrates are environmentally friendly.

Until now, various types of resin substrates have been disclosed, and examples thereof are as follows.

(1) Resin substrates prepared by molding an electroconductive resin including a thermoplastic resin such as polyamides and polyesters, and an electroconductive agent such as carbon black dispersed in the thermoplastic resin;

(2) A resin substrate prepared by molding an electroconductive resin including a thermosetting resin such as phenolic resins, and an electroconductive agent such as carbon black dispersed in the thermosetting resin.

(3) A resin substrate for which a crosslinkable phenolic resin is used as a main component and in which a carbon black is dispersed, wherein the substrate has an outermost layer having a resistance of not higher than $5\times10^5\Omega$, and wherein the purpose is to improve surface smoothness, electric properties, adhesion to photosensitive layers, and resistance to solvents and scratch.

(4) A resin substrate for which a resol-type phenolic resin is used as a main component, wherein the purpose is to provide a substrate having a light weight, and a good combination of electroconductivity, nonmagnetism, heat resistance and dimension stability.

(5) A resin substrate for which a polyamide resin prepared from metaxylylene diamine and adipic acid is used, wherein the purpose is to provide a substrate having a good combination of heat resistance, chemical resistance and mechanical strength.

(6) A resin substrate for which a polyester resin is used, wherein the purpose is to provide a substrate having good dimension stability even under high temperature and high humidity conditions.

(7) A resin substrate for which a mixture of a polyester resin and a polycarbonate resin is used, wherein the purpose is to provide a substrate having a good combination of chemical resistance, moldability, dimension stability, and adhesion to photosensitive layers.

BRIEF SUMMARY OF THE INVENTION

As an aspect of the present invention, a photoreceptor is provided which includes a resin substrate including a resin and a carbon nanotube, and a photosensitive layer located overlying the substrate.

In this regard, "overlying can include direct contact and allow for one or more intermediate layers.

As another aspect of the present invention, a method for producing a photoreceptor is provided which includes forming a resin substrate using a resin forming material including a carbon nanotube; and forming a photosensitive layer overlying the substrate.

The aforementioned and other aspects, features and advantages will become apparent upon consideration of the following description of the preferred embodiments taken in conjunction with the accompanying drawings.

DETAILED DESCRIPTION OF THE INVENTION

Figure 1A:
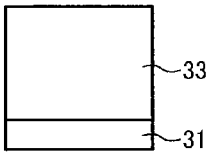
FIGS. 1A-1C are schematic views illustrating examples of a photoreceptor according to an embodiment, which includes a photosensitive layer having both a charge generation function and a charge transport function.

Since the conventional resin substrates mentioned above in paragraph (1) are made of a thermoplastic resin, the resin substrates have poor heat resistance and poor dimension stability particularly under high temperature conditions. In addition, since the resin substrates have poor resistance to solvents such as alcohols and ketones which are typically used for forming photosensitive layers, the resin substrates are dissolved or swelled when contacted with a coating liquid including such a solvent, resulting in deformation of the substrates. Further, it is hard for the resin substrates to have a good combination of mechanical strength and electroconductivity.

The conventional resin substrate mentioned above in paragraph (2) has a good combination of solvent resistance and dimension stability because the substrate is subjected to a thermally hardening treatment, but has an insufficient mechanical strength. In order to enhance the mechanical strength, the resin substrate preferably includes a hardness improving agent such as inorganic or organic fillers. In addition, the resin substrate has to include an electroconductive agent. Namely, the resin substrate includes both a hardness improving agent and an electroconductive agent. In this regard, in order that the resin substrate has sufficient electroconductivity, the electroconductive agent has to be included in the substrate at a high concentration. In this case, the resin substrate has poor mechanical strength. In contrast, when a filler is included in the substrate at a high concentration in order to enhance the mechanical strength, the substrate has insufficient electroconductivity. Thus, it is difficult for the resin substrate to have a good combination of mechanical strength and electroconductivity.

In order that the conventional resin substrate mentioned above in paragraph (3) has a resistance not higher than $5\times10^5\Omega$, an electroconductive agent is preferably included in the substrate at a high concentration. In this case, the resin substrate has poor mechanical strength.

The conventional resin substrate mentioned above in paragraph (4) is similar to the photoreceptor according to an embodiment of the present invention because the resin substrate includes a phenolic resin, and it is difficult for the resin substrate to have a good combination of electroconductivity and mechanical strength.

It is difficult for the conventional resin substrate mentioned above in paragraph (5) to have high dimensional stability.

In addition, it is difficult for the conventional resin substrate mentioned above in paragraph (6) to have a good combination of mechanical strength and electroconductivity while having high dimensional stability.

Further, it is difficult for the resin substrate mentioned above in paragraph (7) to have good solvent resistance.

Thus, there is no conventional resin substrate, which has good durability (such as electric durability and mechanical durability) so as to be used for organic photoreceptors.

The problem to be solved by the present invention is to provide a resin substrate, which has a good combination of solvent resistance and electroconductivity and can maintain good dimensional stability when a photosensitive layer coating liquid is applied on the substrate and which is hardly scratched even when contacted with a device such as chargers, cleaners, and transferring devices. In addition, the substrate hardly causes plastic deformation even when stress is applied thereto by a device such as developing devices and cleaners in an image forming process. Further, the resin substrate hardly causes the above-mentioned scratch/indentation and dent problems, and has good durability, and good dimension stability in a wide range of environmental conditions. Further, the photoreceptor using this resin substrate can produce high quality images and is environmental friendly because $CO_2$ emission can be reduced when manufacturing the photoreceptor.

The photoreceptor according to an embodiment of the present invention includes a resin substrate including a resin and an additive, which is dispersed in the resin and imparts a good combination of mechanical strength and electroconductivity to the substrate, wherein the resin is preferably a thermally-hardened resin. In this application, the term "a hardened resin" means a thermally-hardened resin of a thermosetting resin.

As mentioned above, the substrate used for electrophotographic photoreceptors preferably has a good combination of mechanical strength and electroconductivity. In order to enhance mechanical strength, for example, a hard material such as fillers is added thereto. In order to enhance electroconductivity, an electroconductive agent such as carbon black is added thereto. In this regard, when the added amount of a filler is relatively large compared to that of a carbon black, the electroconductivity of the resultant substrate deteriorates. In contrast, when the added amount of a carbon black is relatively large compared to that of a filler, the mechanical strength of the resultant substrate deteriorates. Namely, mechanical strength and electroconductivity establish a trade-off relationship.

Since carbon nanotube has a nano-structure and a high aspect ratio, carbon nanotube has excellent mechanical strength. In addition, carbon nanotube has electroconductivity not lower than that of carbon black. Therefore, by adding a carbon nanotube to a resin, a good combination of mechanical strength and electroconductivity can be imparted to the resin. However, since carbon nanotube has a needle form, electroconductivity of a resin decreases when the resin including a carbon nanotube is molded while oriented. In this regard, when a carbon black is included in a resin in combination with a carbon nanotube, electroconductivity of the resin can be dramatically enhanced without deteriorating mechanical strength of the resin. In addition, carbon nanotube has good solvent resistance.

Thus, the present inventors discover that by adding a carbon nanotube to a resin, a resin substrate for use in photoreceptors, which has a good combination of mechanical strength, electroconductivity and solvent resistance, can be provided.

The electrophotographic photoreceptor according to an embodiment of the present invention includes at least an electroconductive resin substrate, and a photosensitive layer located overlying the resin substrate, and optionally includes another layer.

The photosensitive layer may have a multi-layered structure or a single-layered structure.

The photosensitive layer having a multi-layered structure includes a charge generation layer having a charge generation function, and a charge transport layer having a charge transport function. The photosensitive layer having a single-layered structure includes a single photosensitive layer having both a charge generation function and a charge transport function.

The resin substrate of the photoreceptor of the present embodiment includes at least a carbon nanotube, and optionally includes a carbon black. Since the resin substrate includes a carbon nanotube, a good combination of mechanical strength and electroconductivity can be imparted to the resin substrate.

The photoreceptor of the present embodiment is characterized by having such an electroconductive resin substrate, and the layer structure and constituents of the photosensitive layer and other optional layers are not particularly limited. Namely, any known photosensitive layers and other layers can be used for the photoreceptor of the present embodiment.

Next, the layer structure of the photoreceptor of the present embodiment will be described by reference to drawings.

Figure 1B:
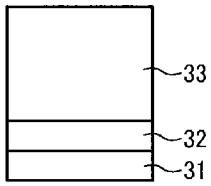
Figure 1C:
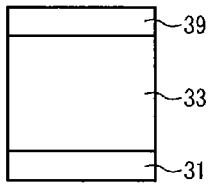

FIGS. 1A-1C are cross-sectional views illustrating examples of the photoreceptor of the present embodiment.

The photoreceptor illustrated in FIG. 1A includes an electroconductive resin substrate 31, and a single-layered photosensitive layer 33, which is located on the resin substrate 31 and which has both a charge generation function and a charge transport function.

The photoreceptor illustrated in FIG. 1B includes the electroconductive resin substrate 31, an undercoat layer 32 located on the resin substrate 31, and the single-layered photosensitive layer 33, which is located on the undercoat layer 32 and which has both a charge generation function and a charge transport function.

The photoreceptor illustrated in FIG. 1C includes the electroconductive resin substrate 31, the single-layered photosensitive layer 33, which is located on the resin substrate 31 and which has both a charge generation function and a charge transport function, and a protective layer 39 (i.e., a crosslinked outermost layer), which is located on the photosensitive layer 33.

Figure 2A:
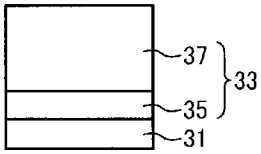
FIGS. 2A-2C are schematic views illustrating other examples of the photoreceptor, in which a charge generation layer and a charge transport layer are overlaid.
Figure 2B:
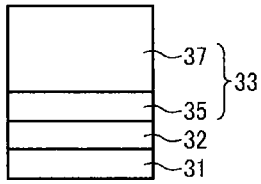
Figure 2C:
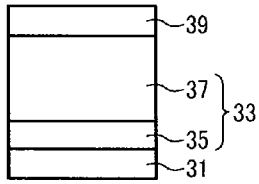

FIGS. 2A-2C are cross-sectional views illustrating other examples of the photoreceptor of the present embodiment.

The photoreceptor illustrated in FIG. 2A includes the electroconductive resin substrate 31, a charge generation layer 35, which is located on the resin substrate 31 and which has a charge generation function, and a charge transport layer 37, which is located on the charge generation layer 35 and which has a charge transport function.

The photoreceptor illustrated in FIG. 2B includes the electroconductive resin substrate 31, the undercoat layer 32 located on the resin substrate 31, the charge generation layer 35, which is located on the undercoat layer 32 and which has a charge generation function, and the charge transport layer 37, which is located on the charge generation layer 35 and which has a charge transport function.

The photoreceptor illustrated in FIG. 2C includes the electroconductive resin substrate 31, the charge generation layer 35, which is located on the resin substrate 31 and which has a charge generation function, the charge transport layer 37, which is located on the charge generation layer 35 and which has a charge transport function, and the protective layer 39 (i.e., a crosslinked outermost layer), which is located on the charge transport layer 37.

The electroconductive resin substrate 31 of the photoreceptor of the present embodiment includes a carbon nanotube, which is dispersed in a resin, and has a volume resistivity of not higher than $10^6\Omega\cdot$cm. Thermoplastic resins and thermosetting resins can be used for forming the resin substrate. Specific examples of such thermoplastic resins include polyethylene resins, polypropylene resins, polystyrene resins, ABS (acrylonitrile-butadiene-styrene) resins, polyvinyl chloride, polycarbonate resins, polyamide resins, polyacetal resins, polybutylene terephthalate resins, and polyethylene terephthalate resins. Specific examples of the thermosetting resins include phenolic resins, urea resins, alkyd resins, melamine resins, epoxy resins, and polyurethane. Thermosetting resins are preferably used because the resultant thermally-hardened resins have a good combination of heat resistance and solvent resistance. Among thermosetting resins, phenolic resins are preferable because the resultant hardened resins have a good combination of mechanical properties, electric properties, chemical properties, heat resistance, and flame resistance while having relatively low costs. Particularly, phenolic resins have better mechanical strength and flame resistance than other thermally-hardened resins, and therefore phenolic resins are particularly preferable.

In this application, a material used for forming a resin of the resin substrate is hereinafter sometimes referred to as a resin forming material. Specific examples of the resin forming material include monomers, oligomers, polymers, precursors of resins, and thermosetting resins (which form thermally-hardened resins).

Phenolic resins are broadly classified into novolac-type phenolic resins, which are prepared by reacting a phenolic compound such as phenol, bisphenol A, xylenol, cresol and resorcinol with an aldehyde compound (such as formaldehyde) using an acid catalyst; and resol-type phenolic resins, which are prepared by reacting such a phenol compound with an aldehyde compound using an alkaline catalyst. Novolac-type phenolic resins have good dimensional stability, but generate ammonia. Therefore, when novolac-type phenolic resins are used for the resin substrate, it is possible that electric properties of the photoreceptor are deteriorated by the substrate. In contrast, since resol-type phenolic resins do not generate ammonia, resol-type phenolic resins are preferably used for the resin substrate.

Hexamethylenetetramine is typically used as a hardener when preparing novolac-type phenolic resins. The added amount of hexamethylenetetramine is generally from 5% to 20% by weight based on the weight of the novolac-type phenolic resin. In contrast, it is not necessary to use a hardener for resol-type phenolic resins.

One or more resin monomers and a carbon nanotube are mixed so that the carbon nanotube is dispersed in the monomers, and the mixture is subjected to molding such as injection molding and extrusion molding to form a cylindrical electroconductive resin substrate.

Carbon nanotube is a material, which is a tube made of one or more carbon networks having a six-membered ring structure, wherein when the tube is made of two or more carbon networks, the networks are coaxial. Particularly, multi-layered carbon nanotube has a good combination of mechanical strength, elasticity and electroconductivity.

In contrast, carbon black has a structure in which a few layers of carbon having a graphite structure (i.e., hexagonal-shape carbon) are overlaid while connected like a chain, and has a particle diameter of from a few nanometers to hundreds of nanometers. The physical properties of carbon black change depending on the particle diameter, structure and surface conditions, and by changing the production method and production conditions so that the properties change, the physical properties such as electroconductivity of carbon black can be controlled.

The content of the electroconductive agent (i.e., a mixture of a carbon nanotube and a carbon black) in the resin substrate is preferably from 1% to 55% by weight based on the total weight of the resin substrate. The content of the electroconductive agent is more preferably from 10% to 45% by weight in order to enhance the electroconductivity, the mechanical strength and the mechanical durability of the resin substrate.

Since carbon nanotube has extremely high mechanical strength while having good electroconductivity, carbon nanotube is very useful for the resin substrate. However, since carbon nanotube has a needle form, carbon nanotube tends to be oriented in a molding process. In this case, the electroconductivity of the resultant resin substrate deteriorates. In this regard, by adding a carbon black, particles of the oriented carbon nanotube are connected with the carbon black, thereby dramatically enhancing electroconductivity of the resin substrate. The weight ratio (CNT/CB) of carbon nanotube (CNT) to carbon black (CB) in the resin substrate is preferably from 9.5/0.5 to 0.5/9.5, and more preferably from 9.0/1.0 to 1.0/9.0. When the weight ratio (CNT/CB) is from 9.5/0.5 to 0.5/9.5, a good combination of electroconductivity and mechanical strength can be imparted to the resin substrate.

The electroconductive resin substrate can include an inorganic or organic filler other than carbon nanotube and carbon black to further enhance the mechanical strength of the substrate. Specific examples of such organic fillers include organic pigments such as phthalocyanine pigments, azo pigments, perylene pigments, anthraquinone pigments, polycyclic quinone pigments, quinoneimine pigments, diphenylmethane pigments, triphenylmethane pigments, benzoquinone pigments, naphthoquinone pigments, cyanine pigments, azomethine pigments, indigoid pigments, and benzimidazole pigments; wood powders, cellulose, and carbon fibers.

Specific examples of such inorganic fillers include metal oxides such as titanium oxide, silica, alumina, zirconium oxide, tin oxide, and indium oxide; and inorganic fibers such as glass fibers and ceramic fibers.

The content of such a filler in the resin substrate is preferably from 0% to 60% by weight based on the total weight of the substrate.

Other fillers such as magnesium oxide, magnesium carbonate, aluminum hydroxide, calcium carbonate, kaolin, white clay, and talc can be used. The content of such a filler in the resin substrate is preferably from 0% to 50% by weight based on the total weight of the substrate.

In order to further enhance electroconductivity of the resin substrate, it is possible that a metal such as aluminum, nickel, chromium, nichrome, copper, gold, silver and platinum; and/or a metal oxide such as tin oxide, and indium oxide, are added to a resin monomer and then the mixture is subjected to molding. Alternatively, it is also possible to form an electroconductive layer on the surface of the electroconductive resin substrate by vapor deposition or sputtering using one or more of these electroconductive materials.

In addition, it is possible to coat the surface of the electroconductive resin substrate with a coating liquid including a binder resin and a particulate electroconductive material dispersed in the binder resin. Specific examples of such a particulate electroconductive material include carbon nanotube, carbon black, acetylene black, powders of a metal such as iron, nichrome, copper, zinc, and silver; and powders of a metal oxide such as electroconductive tin oxide, and indium tin oxide (ITO).

Specific examples of the binder resin used in combination with such a particulate electroconductive material include thermoplastic resins, thermosetting resins, and photocrosslinking resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral, polyvinyl formal, polyvinyl toluene, poly-N-vinyl carbazole, acrylic resins, silicone resins, epoxy resins, melamine resins, urethane resins, phenolic resins, and alkyd resins.

Such an electroconductive layer is typically prepared by coating a coating liquid, which is prepared by dissolving or dispersing a binder resin in a solvent such as tetrahydrofuran, dichloromethane, methyl ethyl ketone, and toluene, and dispersing a particulate electroconductive material therein.

In addition, it is possible to form an electroconductive layer on the surface of the electroconductive resin substrate using a heat shrinking tube which includes a particulate electroconductive material (such as the materials mentioned above) and a binder resin such as polyvinyl chloride, polypropylene, polyester, polystyrene, polyvinylidene chloride, polyethylene, and TEFLON.

The electroconductive resin substrate of the photoreceptor of the present embodiment can be prepared by any known methods. For example, a method including adding a proper amount of carbon nanotube into a thermosetting resin together with an optional filler; mixing the carbon nanotube, the resin and the optional filler at room temperature using a mixer to prepare a composition; and molding the composition using an injection molding machine or an extruder, can be used.

When a cylindrical electroconductive resin substrate is formed, for example, injection molding and extrusion molding can be used. From the viewpoints of productivity and manufacturing costs, extrusion molding is preferable.

Any known extrusion molding methods can be used. For example, a screw extrusion molding method for molding a thermosetting resin disclosed in JP-H06-011514-B can be used.

Figure 3:
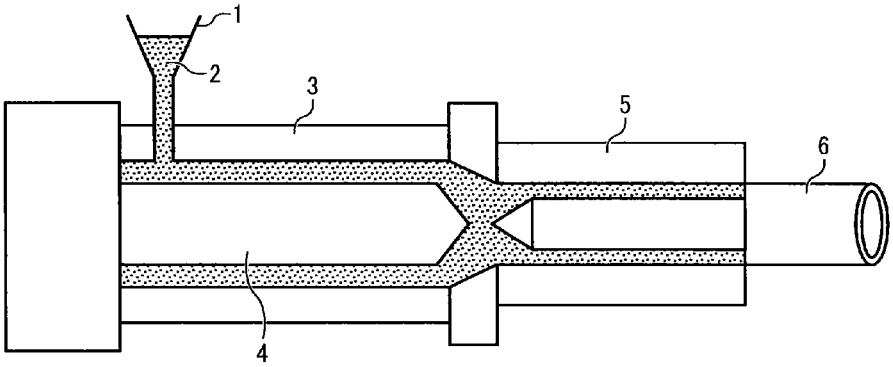
FIG. 3 is a schematic view illustrating an extruder for use in preparing a resin substrate of the photoreceptor.

FIG. 3 is a schematic view illustrating an extruder for use in preparing a resin substrate.

A raw material 2 (such as a resin composition including a carbon nanotube, a thermosetting resin, and an optional filler), which is supplied from a hopper 1, is fed to an extrusion cylinder 3 of the extruder, and then subjected to melt-kneading by an extrusion screw 4. The melted and kneaded raw material is fed by the extrusion screw 4 to an extrusion die 5, thereby forming an electroconductive resin pipe 6 serving as a resin substrate.

The temperature of the extrusion cylinder 3 is generally from 50° C. to 140° C., and preferably from 60° C. to 120° C.

When the temperature of the extrusion cylinder 3 is lower than 50° C., the hardening reaction of the resin composition is not sufficiently performed, and therefore it becomes hard to prepare a pipe having the desired properties. In contrast, when the temperature is higher than 140° C., the resin composition is excessively hardened before reaching the extrusion die 5, thereby making it impossible to extrude the resin composition. The temperature of the extrusion die 5 is preferably higher than the temperature of the extrusion cylinder 3, and is generally from 120° C. to 200° C., and preferably from 140° C. to 170° C.

When the temperature of the extrusion die 5 is lower than 120° C., the hardening reaction of the resin composition is not sufficiently performed, and therefore it becomes hard to prepare a pipe having the desired properties. In contrast, when the temperature is higher than 200° C., the resin composition is excessively hardened before reaching the extrusion die 5, thereby making it impossible to extrude the resin composition.

The hardening temperature in extrusion molding depends on the thermosetting resin used, and is generally from 50° C. to 200° C. When the temperature is lower than 50° C., the hardening reaction is not sufficiently performed, thereby making it impossible to prepare a molded substrate having the desired properties. In contrast, when the temperature is higher than 200° C., the resin composition is excessively hardened before reaching the extrusion die 5, thereby making it impossible to extrude the resin composition.

When a thermoplastic resin is used for forming a cylindrical resin substrate, injection molding and extrusion molding can be used similarly to the case where a thermosetting resin is used. From the viewpoints of productivity and manufacturing costs, extrusion molding is preferable. The temperatures of the extrusion cylinder 3 and the extrusion die 5 are determined depending on the melting point of the thermoplastic resin used. When a popular polyamide resin is used, the temperature of the extrusion cylinder 3 is preferably from 240° C. to 320° C., and the temperature of the extrusion die 5 is from 80° C. to 180° C.

Next, the photosensitive layer will be described. The photosensitive layer may have a single-layered structure or a multi-layered structure.

The multi-layered photosensitive layer includes a charge generation layer having a charge generation function, and a charge transport layer having a charge transport function. The single-layered photosensitive layer has both a charge generation function and a charge transport function.

Each of the multi-layered photosensitive layer and the single-layered photosensitive layer will be described.

Initially, the multi-layered photosensitive layer will be described.

The multi-layered photosensitive layer includes a charge generation layer 35 having a charge generation function. The charge generation layer 35 includes as a main component a charge generation material having a charge generation function. Inorganic charge generation materials and organic charge generation materials can be used as the charge generation material.

Specific examples of such inorganic charge generation materials include crystalline selenium, amorphous selenium, selenium-tellurium compounds, selenium-tellurium-halogen compounds, selenium-arsenic compounds, and amorphous silicon. As for the amorphous silicon, amorphous silicon in which the dangling bond is terminated with a hydrogen atom or a halogen atom, or amorphous silicon which is doped with a boron atom or a phosphorous atom, can be preferably used.

Any known organic charge generation materials can be used as the charge generation material of the charge generation layer 35. Specific examples thereof include phthalocyanine pigments such as metal phthalocyanine and metal-free phthalocyanine; azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenylmethane pigments, triphenylmethane pigments, benzoquinone pigments, naphthoquinone pigments, cyanine pigments, azomethine pigments, indigoid pigments, and benzimidazole pigments. Among these materials, phthalocyanine compounds are preferable and titanylphthalocyanine compounds are more preferable. Among the titanylphthalocyanine compounds, Y-form titanylphthalocyanine compounds having an X-ray diffraction spectrum such that main peaks are observed at Bragg 2 θ angles of 9.6±0.2°, 24.0±0.2°, and 27.2±0.2° are preferable because of having high sensitivity. These charge generation materials can be used alone or in combination.

The charge generation layer optionally includes a binder resin. Specific examples thereof include polyamide, polyurethane, epoxy resins, polyketone, polycarbonate, silicone resins, acrylic resins, polyvinyl butyral, polyvinyl formal, polyvinyl ketone, polystyrene, poly-N-vinyl carbazole, and polyacrylamide. These resins can be used alone or in combination. In addition, charge transport polymers having a charge transport function can be used for the charge generation layer as well as the binder resins mentioned above. Specific examples thereof include polycarbonate, polyester, polyurethane, polyether, polysiloxane and acrylic resins, which have an arylamine skeleton, a benzidine skeleton, a hydrazone skeletone, a carbazole skeleton, a stilbene skeletone, or a pyrazoline skeletone; and polymers having a polysilane skeleton.

The charge generation layer can include a charge transport materials having a low molecular weight.

Suitable materials for use as the low molecular weight charge transport material to be included in the charge generation layer include positive hole transport materials and electron transport materials.

Specific examples of the electron transport materials include known materials having an electron accepting property such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone. These electron transport materials can be used alone or in combination.

Specific examples of the positive hole transport materials include known materials having an electron donating property such as oxazole derivatives, oxadiazole derivatives, imidazole derivatives, monoarylamine derivatives, diarylamine derivatives, triarylamine derivatives, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, and enamine derivatives. These positive hole transport materials can be used alone or in combination.

The method for preparing the charge generation layer is not particularly limited, and a proper method is selected. For example, vacuum thin film forming methods, and casting methods using a solution/dispersion can be used.

Specific examples of such vacuum thin film forming methods include vacuum evaporation methods, glow discharge decomposition methods, ion plating methods, sputtering methods, reaction sputtering methods, and CVD (chemical vapor deposition) methods. A layer including one or more of the above-mentioned inorganic and organic charge generation materials can be formed by one of these methods.

The casting methods useful for forming the charge generation layer include, for example, preparing a coating liquid by dispersing (or dissolving) one or more of the above-mentioned inorganic or organic charge generation materials in a solvent optionally together with a binder resin using a dispersing machine such as ball mills, attritors, sand mills, and bead mills; and applying the dispersion (or solution) after diluting the dispersion, if necessary, to prepare the charge generation layer. Specific examples of the solvent for use in the charge generation layer coating liquid include tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, and butyl acetate.

The charge generation layer coating liquid can optionally include a leveling agent such as dimethylsilicone oils, and methylphenylsilicone oils. Specific examples of the coating methods include dip coating, spray coating, bead coating, and ring coating.

The thickness of the charge generation layer is preferably from 0.01 μm to 5 μm, and more preferably from 0.05 μm to 2 μm.

The charge transport layer 37 is a layer having a charge transport function, and is typically prepared by applying a coating liquid, which is prepared by dissolving or dispersing a charge transport material having a charge transport function and a binder resin in a proper solvent, on the charge generation layer, followed by drying the coated liquid. The thickness of the charge transport layer is from 5 nm to 40 nm, and preferably from 10 nm to 30 nm.

Specific examples of the charge transport material to be included in the charge transport layer include the electron transport materials, the positive hole transport materials, and the charge transport polymers, which are mentioned above for use in the charge generation layer.

Specific examples of the binder resin for use in the charge transport layer include known thermoplastic resins, and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylates, phenoxy resins, polycarbonate, cellulose acetate resins, ethyl cellulose resins, polyvinyl butyral, polyvinyl formal, polyvinyl toluene, poly-N-vinyl carbazole, acrylic resins, silicone resins, epoxy resins, melamine resins, urethane resins, phenolic resins, and alkyd resins.

Solvents similar to the solvents mentioned above for use in preparing the charge generation layer coating liquid are used for the charge transport layer coating liquid, and one or more solvents capable of dissolving the charge transport material and the binder resin used for the charge transport layer are preferably used. Coating methods mentioned above for use in preparing the charge generation layer can be used for preparing the charge transport layer.

The charge transport layer coating liquid can optionally include an additive such as plasticizers and leveling agents. Specific examples of the plasticizers include plasticizers for use in resins such as dibutyltin phthalate, and dioctyltin phthalate. The added amount of a plasticizer is generally from 0% to 30% by weight based on the weight of the binder resin included in the charge transport layer coating liquid.

Specific examples of the leveling agents include silicone oils (such as dimethylsilicone oils, and methylphenylsilicone oils), and polymers and oligomers having a perfluoroalkyl group in their side chains. The added amount of a leveling agent is preferably from 0% to 1% by weight based on the weight of the binder resin included in the charge transport layer coating liquid.

Next, the single-layered photosensitive layer 33 will be described.

The single-layered photosensitive layer 33 is typically prepared by applying a coating liquid which is prepared by dissolving or dispersing a charge generation material having a charge generation function, a charge transport material having a charge transport function, and a binder resin in a proper solvent; and then drying the applied liquid. The coating liquid optionally includes an additive such as plasticizers and leveling agents. The above-mentioned dispersing method for dispersing a charge generation material can be used for forming the photosensitive layer, and the charge generation material, the charge transport material, the plasticizer, and the leveling agent are described above when describing the charge generation layer and the charge transport layer can be used for the photosensitive layer. With respect to the binder resin, one or more of the binder resins mentioned above for use in preparing the charge generation layer can be used in combination with one or more of the binder resins mentioned above for use in preparing the charge transport layer. The thickness of the charge transport layer is generally form 5 μm to 30 μm, and preferably from 10 μm to 25 μm.

Next, the undercoat layer 32 will be described. The photoreceptor of the present embodiment can have the undercoat layer 32 between the electroconductive resin substrate 31 and the photosensitive layer such as the charge generation layer 35 or the single-layered photosensitive layer 33.

The undercoat layer includes a resin as a main component. Since the photosensitive layer is formed on the undercoat layer typically by coating a coating liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylons; and hardening resins capable of forming a three-dimensional network such as polyurethane resins, melamine resins, phenolic resins, alkyd-melamine resins, and epoxy resins. In addition, the undercoat layer can include a metal oxide powder to prevent formation of moiré in the resultant images and to decrease the potential of irradiated portions (i.e., residual potential) of the resultant photoreceptor. Specific examples of the metal oxides include titanium oxide, silica, alumina, zirconium oxide, tin oxide, and indium oxide.

The undercoat layer is typically formed by applying a coating liquid including a resin, an optional particulate material, and a proper solvent using a proper coating method such as the coating methods mentioned above for use in preparing the charge generation layer and the charge transport layer. The undercoat layer may be formed using a silane coupling agent, a titanium coupling agent, or a chromium coupling agent. In addition, a layer of aluminum oxide which is formed by an anodic oxidation method, and a layer of an organic compound such as polyparaxylylene and an inorganic compound such as $SiO_2$, $SnO_2$, $TiO_2$, ITO and $CeO_2$, which is formed by a vacuum evaporation method, can also be preferably used as the undercoat layer. However, the undercoat layer is not limited thereto, and any known undercoat layers can be used. The thickness of the undercoat layer is preferably 0 to 5 μm.

Next, the protective layer 39 will be described. The photoreceptor of the present embodiment can include the protective layer 39 as the outermost layer thereof. The protective layer 39 includes a resin as a main component. Specific examples of the resin include acrylonitrile-butadiene-styrene resins (ABS resins), acrylonitrile-chlorinated polyethylene-styrene resins (ACS resins), olefin-vinyl monomer copolymers, chlorinated polyether, aryl resins, phenolic resins, polyacetal, polyamide, polyamideimide, polyacrylate, polyarylsulfone, poybutylene, polybutylene terephthalate, polycarbonate, polyarylate, polyethersulfone, polyethylene, polyethylene terephthalate, polyimide, acrylic resins, polymethylpentene, polypropylene, polyphenylene oxide, polysulfone, polystyrene, acrylonitrile-styrene resins (AS resins), butadiene-styrene copolymers, polyurethane, polyvinyl chloride, polyvinylidene chloride, and epoxy resins. Among these resins, polycarbonate and polyarylate are preferable.

In order to enhance the abrasion resistance of the protective layer 39, a resin such as fluorine-containing resins and silicone resins can be used for the protective layer. In this regard, a filler such as inorganic fillers (e.g., tin oxide, potassium titanate, and silica), and organic fillers may be dispersed in the resin. Specific examples of such organic fillers include powders of fluorine-containing resins such as polytetrafluoroethylene, powders of silicone resins, and powders of amorphous carbon. Specific examples of the inorganic filler include powders of metals such as copper, tin, aluminum, and indium, and powders of inorganic materials such as metal oxides (e.g., silica, tin oxide, zinc oxide, titanium oxide, indium oxide, antimony oxide, bismuth oxide, antimony-doped tin oxide, and tin-doped indium oxide), and potassium titanate.

Among these fillers, inorganic fillers are preferable from the viewpoint of hardness. Particularly, silica, titanium oxide and alumina are preferable.

The content of a filler in the protective layer 39 is determined based on the property of the filler used, and the process conditions of the image forming apparatus for which the photoreceptor is used. However, the content of a filler in the surface portion of the protective layer is not less than 5% by weight, and preferably not less than 10% by weight, based on the total weight of the solid components included in the protective layer. The content of a filler is generally not greater than 50% by weight, and preferably not greater than 30% by weight.

In order to reduce the residual potential of the photoreceptor and to enhance the response of the photoreceptor, the protective layer 39 can include a charge transport material.

Specific examples of the charge transport material include the charge transport materials mentioned above for use in the charge transport layer. When a low molecular weight charge transport material is used, the layer may have a gradient-like concentration of the charge transport material in the depth direction. In this case, it is preferable that the layer has a gradient-like concentration of the charge transport material such that the concentration of the charge transport material at the surface of the protective layer is lower than that at the bottom of the protective layer. In this regard, the concentration means the weight ratio of the low molecular weight charge transport material to the total weight of the materials constituting the protective layer.

The protective layer is typically prepared by using a coating method. The thickness of the protective layer is generally from 0.1 μm to 10 μm.

The protective layer may be a protective layer having a crosslinked structure. Such a crosslinked protective layer is typically prepared by subjecting one or more reactive monomers having plural crosslinkable functional groups in a molecule to a crosslinking reaction using light or heat energy so that the protective layer can have a three-dimensional network. The thus prepared three-dimensional network serves as a binder resin, and thereby a high abrasion resistance can be imparted to the protective layer. In this regard, it is preferable that all or some of the reactive monomers have a charge transport function, because a charge transport portion is formed in the network, and thereby the function of the protective layer can be fully fulfilled. Specific examples of the monomer having a charge transport function include reactive monomers having a triarylamine structure.

A protective layer having such a three dimensional network has good abrasion resistance, but often causes large volume contraction in the crosslinking reaction. Therefore, when such a protective layer is too thick, cracks tend to be formed therein. In order to prevent formation of cracks, the protective layer may have a multi-layered structure such that a crosslinked protective layer is located on a protective layer in which a low molecular weight charge transport material is dispersed in a polymer.

Among various crosslinked protective layers, the following crosslinked protective layer is preferable.

Specifically, a crosslinked protective layer prepared by subjecting a radically polymerizable tri- or more-functional monomer having no charge transport structure and a radically polymerizable monofunctional monomer having a charge transport structure to a crosslinking reaction is preferable. Since the crosslinked structure is prepared by using a radically polymerizable monomer having three or more functional groups, the crosslinked structure has a well-developed three dimensional network. Therefore, the protective layer has a high crosslinkage density, high hardness, and high elasticity while having uniform surface. Therefore, a good combination of abrasion resistance and scratch resistance can be imparted to the photoreceptor.

In addition, a layer of amorphous carbon or amorphous silicon carbide prepared by a vacuum thin film forming method can also be used as the protective layer 39.

The photoreceptor of the present embodiment can have an intermediate layer between the photosensitive layer (such as the single-layered photosensitive layer 33 or the charge transport layer 37) and the protective layer 39. The intermediate layer includes a binder resin as a main component.

Specific examples of the resin include polyamide, alcohol-soluble nylon, water-soluble polyvinyl butyral, polyvinyl butyral, and polyvinyl alcohol.

The intermediate layer is typically prepared by such a coating method as mentioned above. The thickness of the intermediate layer is generally from 0.05 μm to 2 μm.

In order to enhance stability of the photoreceptor to withstand environmental conditions, particularly, to prevent deterioration of photosensitivity and increase of residual potential, each of the layers such as the protective layer, the charge generation layer, the charge transport layer, and the undercoat layer can include an antioxidant.

Suitable antioxidants for use in the layers of the photoreceptor include the following compounds, but are not limited thereto.

Phenolic Compounds 2,6-Di-t-butyl-p-cresol, butylated hydroxyanisole, 2,6-di-t-butyl-4-ethylphenol, stearyl-β-(3,5-di-t-butylphenol-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3', 5'-di-t-butyl-4'-hydroxyphenyl)propionate]methane, bis[3,3'-bis(4'-hydroxy-3'-t-butylphenyl)butyric acid]glycol ester, and tocopherol compounds.

Paraphenylenediamine Compounds

N-Phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinone Compounds 2,5-Di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organic Phosphorus-Containing Compounds

Triphenylphosphine, tri(nonylphenyl)phosphine, tri(di-nonylphenyl)phosphine, tricresylphosphine, and tri(2,4-dibutylphenoxy)phosphine.

Since these compounds are known as antioxidants for rubbers, plastics, oils and fats, the compounds can be commercially available.

The content of such an antioxidant in the layers is generally from 0.01% to 10% by weight based on the total weight of the layer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed at room temperature.

| | |
|---|---|
| Polyamide resin (RENY 6002 from Mitsubishi Engineering-Plastics Corporation) | 175 parts |
| Carbon nanotube (VGCF-X from Showa Denko K.K.) | 75 parts |

The mixture was kneaded using a mixing mill to prepare a polyamide resin composition.

The polyamide resin composition was subjected to injection molding at 270° C. using an injection molding machine to prepare a test piece having a size described in JIS K 7171. Specifically, the size of the test piece is the following.

Length: 80.0±12.0 mm

Width: 10.0±10.2 mm

Thickness: 4.0±10.2 mm

Thus, a test piece of Example 1 was prepared.

Example 2

The following components were mixed at room temperature.

| | |
|---|---|
| Resol-type phenolic resin (TS-10 from ASAHI ORGANIC CHEMICALS INDUSTRY CO., LTD.) | 248 parts |
| Carbon nanotube (VGCF-X from Showa Denko K.K.) | 2 parts |

The mixture was kneaded using a mixing mill to prepare a phenolic resin composition.

The phenolic resin composition was subjected to injection molding while hardened at 160° C. using an injection molding machine to prepare a test piece having a size described in JIS K 7171.

Thus, a test piece of Example 2 was prepared.

Example 3

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 245 parts |
| Carbon nanotube (VGCF-X from Showa Denko K.K.) | 5 parts |

Thus, a test piece of Example 3 was prepared.

Example 4

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 230 parts |
| Carbon nanotube (VGCF-X from Showa Denko K.K.) | 20 parts |

Thus, a test piece of Example 4 was prepared.

Example 5

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 200 parts |
| Carbon nanotube (VGCF-X from Showa Denko K.K.) | 50 parts |

Thus, a test piece of Example 5 was prepared.

Example 6

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 175 parts |
| Carbon nanotube (VGCF-X from Showa Denko K.K.) | 75 parts |

Thus, a test piece of Example 6 was prepared.

Example 7

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 150 parts |
| Carbon nanotube (VGCF-X from Showa Denko K.K.) | 100 parts |

Thus, a test piece of Example 7 was prepared.

Example 8

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 120 parts |
| Carbon nanotube (VGCF-X from Showa Denko K.K.) | 130 parts |

Thus, a test piece of Example 8 was prepared.

Example 9

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 105 parts |
| Carbon nanotube (VGCF-X from Showa Denko K.K.) | 145 parts |

Thus, a test piece of Example 9 was prepared.

Example 10

The procedure for preparation of the test piece of Example 2 was repeated except that the formula was changed to the following.

| | |
|---|---|
| Resol-type phenolic resin (TS-10 from ASAHI ORGANIC CHEMICALS INDUSTRY CO., LTD.) | 102 parts |
| Carbon nanotube (VGCF-X from Showa Denko K.K.) | 148 parts |

Thus, a test piece of Example 10 was prepared.

Example 11

The procedure for preparation of the test piece of Example 6 was repeated except that the phenolic resin was replaced with an epoxy resin from Nippon Steel Chemical Co., Ltd.

Thus, a test piece of Example 11 was prepared.

Comparative Example 1

The procedure for preparation of the test piece of Example 6 was repeated except that the carbon nanotube was replaced with a carbon black (#3400B from Mitsubishi Chemical Corporation).

Thus, a test piece of Comparative Example 1 was prepared.

Each of the test pieces of Examples 1-11 and Comparative Example 1 was subjected to a bending test described in JIS K 7171 to evaluate the bending property (bending elastic modulus) of the test pieces. Specifically, the test piece was set on two points of support, and the center of the portions supported by the two points was pressed by an indenter at a predetermined speed to obtain a curve showing the relation between the bending stress and deflection of the test piece. Next, the bending elastic modulus (in units of MPa) was calculated from the curve.

In addition, the volume resistivity of each test piece was measured with a resistivity meter LORESTA EP from Mitsubishi Chemical Analytech Co., Ltd. Further, each test piece was dipped into tetrahydrofuran for 24 hours to evaluate the solvent resistance.

The evaluation results are shown in Table 1.

TABLE 1

| | Resin | Electro-conductive material | Content of electro-conductive material (% by weight) | Bending elastic modulus (MPa) | Volume resistivity (Ω · cm) | Solvent resistance |
|---|---|---|---|---|---|---|
| Ex. 1 | Polyamide | Carbon nanotube | 30.0 | 64.4 | $5.9 \times 10^3$ | Swelled |
| Ex. 2 | Phenolic resin | Carbon nanotube | 0.8 | 76.7 | $5.7 \times 10^5$ | Not changed |
| Ex. 3 | Phenolic resin | Carbon nanotube | 2.0 | 91.4 | $4.7 \times 10^4$ | Not changed |
| Ex. 4 | Phenolic resin | Carbon nanotube | 8.0 | 140.1 | $1.7 \times 10^3$ | Not changed |
| Ex. 5 | Phenolic resin | Carbon nanotube | 20.0 | 180.2 | $8.7 \times 10$ | Not changed |
| Ex. 6 | Phenolic resin | Carbon nanotube | 30.0 | 165.8 | $2.8 \times 10$ | Not changed |
| Ex. 7 | Phenolic resin | Carbon nanotube | 40.0 | 140.9 | $1.1 \times 10$ | Not changed |
| Ex. 8 | Phenolic resin | Carbon nanotube | 52.0 | 102.5 | 7.7 | Not changed |
| Ex. 9 | Phenolic resin | Carbon nanotube | 58.0 | 92.2 | 5.7 | Not changed |

TABLE 1-continued

| | Resin | Electro-conductive material | Content of electro-conductive material (% by weight) | Bending elastic modulus (MPa) | Volume resistivity (Ω · cm) | Solvent resistance |
|---|---|---|---|---|---|---|
| Ex. 10 | Phenolic resin | Carbon nanotube | 59.2 | 87.6 | 4.4 | Not changed |
| Ex. 11 | Epoxy resin | Carbon nanotube | 30.0 | 23.1 | 3.4 × 10 | Swelled |
| Comp. Ex. 1 | Phenolic resin | Carbon black | 30.0 | 41.5 | $5.3 \times 10^3$ | Not changed |

Example 12

The polyamide resin composition prepared in Example 1 was fed into the extruder illustrated in FIG. 3 so as to be subjected to extrusion molding under the following conditions.

Temperature of the extrusion cylinder 3: 270° C.

Temperature of the extrusion die 5: 130° C.

As a result, a cylindrical electroconductive resin substrate having an outer diameter of 60 mm and an inner diameter of 54 mm was prepared.

Formation of Undercoat Layer

An undercoat layer coating liquid having the following formula was prepared.

| | |
|---|---|
| Alkyd resin (BECKOSOL 1307-60-EL from DIC Corporation) | 6 parts |
| Melamine resin (SUPER BECKAMINE G-821-60 from DIC Corporation) | 4 parts |
| Titanium oxide (CR-EL from Ishihara Sangyo Kaisha Ltd.) | 40 parts |
| Methyl ethyl ketone | 50 parts |

The undercoat layer coating liquid was applied on the outer surface of the resin substrate, followed by drying to prepare an undercoat layer having a thickness of 3.5 m.

Formation of Charge Generation Layer

A charge generation layer coating liquid having the following formula was prepared.

| | |
|---|---|
| Y-form titanylphthalocyanine | 2.5 parts |
| Polyvinyl butyral (BX-1 from Sekisui Chemical Co., Ltd.) | 1.0 part |
| Methyl ethyl ketone | 100 parts |

The charge generation layer coating liquid was applied on the undercoat layer, followed by drying to prepare a charge generation layer having a thickness of 0.2 μm.

Formation of Charge Transport Layer

A charge transport layer coating liquid having the following formula was prepared.

| | |
|---|---|
| Bisphenol Z-form polycarbonate (PANLITE TS-2050 from TEIJIN CHEMICALS LTD.) | 10 parts |
| Low molecular weight charge transport material having the following formula (I) | 7 part |

-continued (I)

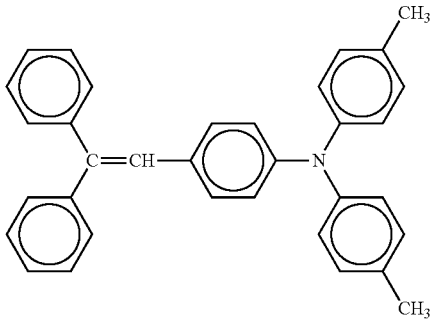

| | |
|---|---|
| Tetrahydrofuran | 100 parts |
| 1% tetrahydrofuran solution of silicone oil (silicone oil: KF50-100CS from Shin-Etsu Chemical Co., Ltd.) | 1 part |

The charge transport layer coating liquid was applied on the charge generation layer, followed by drying to prepare a charge transport layer having a thickness of 25 μm.

Thus, an electrophotographic photoreceptor of Example 12 was prepared.

Example 13

The procedure for preparation of the electrophotographic photoreceptor of Example 12 was repeated except that the resin substrate was prepared as follows.

The phenolic resin composition prepared in Example 2 was fed into the extruder illustrated in FIG. 3 so as to be subjected to extrusion molding under the below-mentioned conditions, to prepare a cylindrical electroconductive resin substrate having an outer diameter of 60 mm and an inner diameter of 54 mm.

Temperature of the extrusion cylinder 3: 100° C.

Temperature of the extrusion die 5: 160° C.

Thus, an electrophotographic photoreceptor of Example 13 was prepared.

Example 14

The procedure for preparation of the electrophotographic photoreceptor of Example 13 was repeated except that the phenolic resin composition was replaced with the phenolic resin composition prepared in Example 3.

Thus, an electrophotographic photoreceptor of Example 14 was prepared.

Example 15

The procedure for preparation of the electrophotographic photoreceptor of Example 13 was repeated except that the phenolic resin composition was replaced with the phenolic resin composition prepared in Example 4.

Thus, an electrophotographic photoreceptor of Example 15 was prepared.

Example 16

The procedure for preparation of the electrophotographic photoreceptor of Example 13 was repeated except that the phenolic resin composition was replaced with the phenolic resin composition prepared in Example 5.

Thus, an electrophotographic photoreceptor of Example 16 was prepared.

Example 17

The procedure for preparation of the electrophotographic photoreceptor of Example 13 was repeated except that the phenolic resin composition was replaced with the phenolic resin composition prepared in Example 6.

Thus, an electrophotographic photoreceptor of Example 17 was prepared.

Example 18

The procedure for preparation of the electrophotographic photoreceptor of Example 13 was repeated except that the phenolic resin composition was replaced with the phenolic resin composition prepared in Example 7.

Thus, an electrophotographic photoreceptor of Example 18 was prepared.

Example 19

The procedure for preparation of the electrophotographic photoreceptor of Example 13 was repeated except that the phenolic resin composition was replaced with the phenolic resin composition prepared in Example 8.

Thus, an electrophotographic photoreceptor of Example 19 was prepared.

Example 20

The procedure for preparation of the electrophotographic photoreceptor of Example 13 was repeated except that the phenolic resin composition was replaced with the phenolic resin composition prepared in Example 9.

Thus, an electrophotographic photoreceptor of Example 20 was prepared.

Example 21

The procedure for preparation of the electrophotographic photoreceptor of Example 13 was repeated except that the phenolic resin composition was replaced with the phenolic resin composition prepared in Example 10.

Thus, an electrophotographic photoreceptor of Example 21 was prepared.

Example 22

The procedure for preparation of the electrophotographic photoreceptor of Example 13 was repeated except that the phenolic resin composition was replaced with the epoxy resin composition prepared in Example 11.

Thus, an electrophotographic photoreceptor of Example 22 was prepared.

Comparative Example 2

The procedure for preparation of the electrophotographic photoreceptor of Example 13 was repeated except that the phenolic resin composition was replaced with the phenolic resin composition prepared in Comparative Example 1.

Thus, an electrophotographic photoreceptor of Comparative Example 2 was prepared.

Each of the photoreceptors of Examples 12 to 22 and Comparative Example 2 was evaluated as follows.

The photoreceptor was set into an image forming apparatus, IMAGIO MP3350 from Ricoh Co., Ltd., and copies of a half-tone image were produced under an environmental condition of 25° C. and 55% RH. In addition, after the image forming apparatus was allowed to settle for 24 hours under an environmental condition of 30° C. and 90% RH, copies of the half-tone image were produced. The image quality of the copies of the half-tone image was evaluated as follows.

Excellent: The copied half-tone image has good uniformity.

Good: The copied half-tone image has slight unevenness.

Acceptable: The copied half-tone image has unevenness.

Bad: Omissions (non image portions) are observed on the entire area of the copied half-tone image.

The evaluation results are shown in Table 2 below.

TABLE 2

| | Resin used for substrate | Electro-conductive material used for substrate | Content of electro-conductive material | Quality of half-tone image 25° C./55% RH | Quality of half-tone image 30° C./90% RH |
|---|---|---|---|---|---|
| Ex. 12 | Polyamide | Carbon nanotube | 30.0 | Acceptable | Acceptable |
| Ex. 13 | Phenolic resin | Carbon nanotube | 0.8 | Good | Good |
| Ex. 14 | Phenolic resin | Carbon nanotube | 2.0 | Excellent | Good |
| Ex. 15 | Phenolic resin | Carbon nanotube | 8.0 | Excellent | Excellent |
| Ex. 16 | Phenolic resin | Carbon nanotube | 20.0 | Excellent | Excellent |
| Ex. 17 | Phenolic resin | Carbon nanotube | 30.0 | Excellent | Excellent |
| Ex. 18 | Phenolic resin | Carbon nanotube | 40.0 | Excellent | Good |

TABLE 2-continued

| | Resin used for substrate | Electro-conductive material used for substrate | Content of electro-conductive material | Quality of half-tone image 25° C./55% RH | 30° C./90% RH |
|---|---|---|---|---|---|
| Ex. 19 | Phenolic resin | Carbon nanotube | 52.0 | Excellent | Good |
| Ex. 20 | Phenolic resin | Carbon nanotube | 58.0 | Good | Acceptable |
| Ex. 21 | Phenolic resin | Carbon nanotube | 59.2 | Acceptable | Acceptable |
| Ex. 22 | Epoxy resin | Carbon nanotube | 30.0 | Acceptable | Bad |
| Comp. Ex. 2 | Phenolic resin | Carbon black | 30.0 | Bad | Bad |

Example 23

The following components were mixed at room temperature.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 9.5 parts |
| Carbon black (TOKABLACK #5500 from Tokai Carbon Co., Ltd.) | 0.5 parts |
| Glass fiber (CS 6 SK-406 from Nitto Boseki Co., Ltd.) | 30 parts |

The mixture was kneaded using a mixing mill to prepare a phenolic resin composition.

The phenolic resin composition was subjected to injection molding at 160° C. using an injection molding machine to prepare a test piece having a size described in JIS K 7171.

Thus, a test piece of Example 23 was prepared.

Example 24

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 8.5 parts |
| Carbon black (TOKABLACK #5500 from Tokai Carbon Co., Ltd.) | 1.5 parts |
| Glass fiber (CS 6 SK-406 from Nitto Boseki Co., Ltd.) | 30 parts |

Thus, a test piece of Example 24 was prepared.

Example 25

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |

-continued

| | |
|---|---|
| Carbon nanotube (VGCF-X from Showa Denko K.K.) | 7.5 parts |
| Carbon black (TOKABLACK #5500 from Tokai Carbon Co., Ltd.) | 2.5 parts |
| Glass fiber (CS 6 SK-406 from Nitto Boseki Co., Ltd.) | 30 parts |

Thus, a test piece of Example 25 was prepared.

Example 26

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 6.5 parts |
| Carbon black (TOKABLACK #5500 from Tokai Carbon Co., Ltd.) | 3.5 parts |
| Glass fiber (CS 6 SK-406 from Nitto Boseki Co., Ltd.) | 30 parts |

Thus, a test piece of Example 26 was prepared.

Example 27

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 5.0 parts |
| Carbon black (TOKABLACK #5500 from Tokai Carbon Co., Ltd.) | 5.0 parts |
| Glass fiber (CS 6 SK-406 from Nitto Boseki Co., Ltd.) | 30 parts |

Thus, a test piece of Example 27 was prepared.

Example 28

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 3.5 parts |
| Carbon black (TOKABLACK #5500 from Tokai Carbon Co., Ltd.) | 6.5 parts |
| Glass fiber (CS 6 SK-406 from Nitto Boseki Co., Ltd.) | 30 parts |

Thus, a test piece of Example 28 was prepared.

Example 29

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 2.5 parts |
| Carbon black (TOKABLACK #5500 from Tokai Carbon Co., Ltd.) | 7.5 parts |
| Glass fiber (CS 6 SK-406 from Nitto Boseki Co., Ltd.) | 30 parts |

Thus, a test piece of Example 29 was prepared.

Example 30

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 1.5 parts |
| Carbon black (TOKABLACK #5500 from Tokai Carbon Co., Ltd.) | 8.5 parts |
| Glass fiber (CS 6 SK-406 from Nitto Boseki Co., Ltd.) | 30 parts |

Thus, a test piece of Example 30 was prepared.

Example 31

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon nanotube (VGCF-X from Showa Denko K.K.) | 0.5 parts |
| Carbon black (TOKABLACK #5500 from Tokai Carbon Co., Ltd.) | 9.5 parts |
| Glass fiber (CS 6 SK-406 from Nitto Boseki Co., Ltd.) | 30 parts |

Thus, a test piece of Example 31 was prepared.

Example 32

The procedure for preparation of the test piece of Example 27 was repeated except that the resol-type phenolic resin was replaced with an epoxy resin from Nippon Steel Chemical Co., Ltd.

Thus, a test piece of Example 32 was prepared.

Comparative Example 3

The procedure for preparation of the test piece of Example 23 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon black (TOKABLACK #5500 from Tokai Carbon Co., Ltd.) | 10.0 parts |
| Glass fiber (CS 6 SK-406 from Nitto Boseki Co., Ltd.) | 30 parts |

Thus, a test piece of Comparative Example 3 was prepared.

Each of the test pieces of Examples 23-32 and Comparative Example 3 was subjected to the bending test described in ES K7171 to evaluate the bending property (bending elastic modulus) of the test pieces. In addition, the volume resistivity of each test piece was measured with a resistivity meter LORESTA EP from Mitsubishi Chemical Analytech Co., Ltd. Further, each test piece was dipped into tetrahydrofuran for 24 hours to evaluate the solvent resistance.

The evaluation results are shown in Table 3.

TABLE 3

| | Resin | Carbon nanotube/carbon black ratio | Bending elastic modulus (MPa) | Volume resistivity (Ω · cm) | Solvent resistance |
|---|---|---|---|---|---|
| Ex. 23 | Phenolic resin | 9.5/0.5 | 180.4 | $4.7 \times 10$ | Not changed |
| Ex. 24 | Phenolic resin | 8.5/1.5 | 160.7 | 1.8 | Not changed |
| Ex. 25 | Phenolic resin | 7.5/2.5 | 150.5 | $7.8 \times 10^{-1}$ | Not changed |
| Ex. 26 | Phenolic resin | 6.5/3.5 | 142.6 | $3.9 \times 10^{-1}$ | Not changed |
| Ex. 27 | Phenolic resin | 5.0/5.0 | 137.2 | $3.8 \times 10^{-1}$ | Not changed |
| Ex. 28 | Phenolic resin | 3.5/6.5 | 129.1 | $4.4 \times 10^{-1}$ | Not changed |
| Ex. 29 | Phenolic resin | 2.5/7.5 | 121.4 | $6.6 \times 10^{-1}$ | Not changed |
| Ex. 30 | Phenolic resin | 1.5/8.5 | 112.5 | 1.9 | Not changed |
| Ex. 31 | Phenolic resin | 0.5/9.5 | 88.2 | $4.5 \times 10^{-2}$ | Not changed |
| Ex. 32 | Epoxy resin | 5.0/5.0 | 77.8 | 9.1 | Swelled |
| Comp. Ex. 3 | Epoxy resin | 0/10.0 | 73.4 | $1.3 \times 10^{-3}$ | Not changed |

Example 33

The phenolic resin composition prepared in Example 23 was fed into the extruder illustrated in FIG. 3 so as to be subjected to extrusion molding under the following conditions.

Temperature of the extrusion cylinder 3: 100° C.

Temperature of the extrusion die 5: 160° C.

As a result, a cylindrical electroconductive resin substrate having an outer diameter of 60 mm and an inner diameter of 54 mm was prepared.

Formation of Undercoat Layer

An undercoat layer coating liquid having the following formula was prepared.

| | |
|---|---|
| Alkyd resin (BECKOSOL 1307-60-EL from DIC Corporation) | 6 parts |
| Melamine resin (SUPER BECKAMINE G-821-60 from DIC Corporation) | 4 parts |
| Titanium oxide (CR-EL from Ishihara Sangyo Kaisha Ltd.) | 40 parts |
| Methyl ethyl ketone | 50 parts |

The undercoat layer coating liquid was applied on the outer surface of the resin substrate, followed by drying to prepare an undercoat layer having a thickness of 3.5 μm.

Formation of Charge Generation Layer

A charge generation layer coating liquid having the following formula was prepared.

| | |
|---|---|
| Y-form titanylphthalocyanine | 2.5 parts |
| Polyvinyl butyral (BX-1 from Sekisui Chemical Co., Ltd.) | 1.0 part |
| Methyl ethyl ketone | 100 parts |

The charge generation layer coating liquid was applied on the undercoat layer, followed by drying to prepare a charge generation layer having a thickness of 0.2 μm.

Formation of Charge Transport Layer

A charge transport layer coating liquid having the following formula was prepared.

| | |
|---|---|
| Bisphenol Z-form polycarbonate (PANLITE TS-2050 from TEIJIN CHEMICALS LTD.) | 10 parts |
| Low molecular weight charge transport material having the following formula (I) | 7 part |

(I)

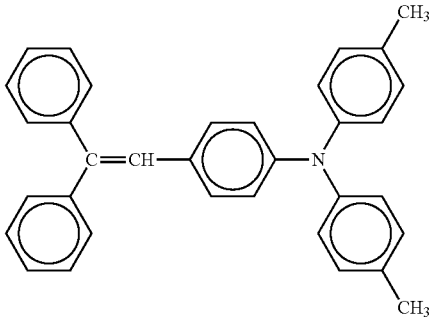

| | |
|---|---|
| Tetrahydrofuran | 100 parts |
| 1% tetrahydrofuran solution of silicone oil (silicone oil: KF50-100CS from Shin-Etsu Chemical Co., Ltd.) | 1 part |

The charge transport layer coating liquid was applied on the charge generation layer, followed by drying to prepare a charge transport layer having a thickness of 25 μm.

Thus, an electrophotographic photoreceptor of Example 33 was prepared.

Example 34

The procedure for preparation of the photoreceptor of Example 33 was repeated except that the phenolic resin composition was replaced with the phenolic resin composition of Example 24.

Thus, an electrophotographic photoreceptor of Example 34 was prepared.

Example 35

The procedure for preparation of the photoreceptor of Example 33 was repeated except that the phenolic resin composition was replaced with the phenolic resin composition of Example 25.

Thus, an electrophotographic photoreceptor of Example 35 was prepared.

Example 36

The procedure for preparation of the photoreceptor of Example 33 was repeated except that the phenolic resin composition was replaced with the phenolic resin composition of Example 26.

Thus, an electrophotographic photoreceptor of Example 36 was prepared.

Example 37

The procedure for preparation of the photoreceptor of Example 33 was repeated except that the phenolic resin composition was replaced with the phenolic resin composition of Example 27.

Thus, an electrophotographic photoreceptor of Example 37 was prepared.

Example 38

The procedure for preparation of the photoreceptor of Example 33 was repeated except that the phenolic resin composition was replaced with the phenolic resin composition of Example 28.

Thus, an electrophotographic photoreceptor of Example 38 was prepared.

Example 39

The procedure for preparation of the photoreceptor of Example 33 was repeated except that the phenolic resin composition was replaced with the phenolic resin composition of Example 29.

Thus, an electrophotographic photoreceptor of Example 39 was prepared.

Example 40

The procedure for preparation of the photoreceptor of Example 33 was repeated except that the phenolic resin composition was replaced with the phenolic resin composition of Example 30.

Thus, an electrophotographic photoreceptor of Example 40 was prepared.

Example 41

The procedure for preparation of the photoreceptor of Example 33 was repeated except that the phenolic resin composition was replaced with the phenolic resin composition of Example 31.

Thus, an electrophotographic photoreceptor of Example 41 was prepared.

Example 42

The procedure for preparation of the photoreceptor of Example 33 was repeated except that the phenolic resin composition was replaced with the epoxy resin composition of Example 32.

Thus, an electrophotographic photoreceptor of Example 42 was prepared.

Comparative Example 4

The procedure for preparation of the photoreceptor of Example 33 was repeated except that the formula of the phenolic resin composition was changed to the following.

| | |
|---|---|
| Resol-type phenolic resin (TS-10 from ASAHI ORGANIC CHEMICALS INDUSTRY CO., LTD.) | 60 parts |
| Carbon black (TOKABLACK #5500 from Tokai Carbon Co., Ltd.) | 10.0 parts |
| Glass fiber (CS 6 SK-406 from Nitto Boseki Co., Ltd.) | 30 parts |

Thus, an electrophotographic photoreceptor of Comparative Example 4 was prepared.

Each of the photoreceptors of Examples 33 to 42 and Comparative Example 4 was evaluated as follows.

The photoreceptor was set into an image forming apparatus, IMAGIO MP3350 from Ricoh Co., Ltd., and copies of a half-tone image were produced under an environmental condition of 25° C. and 55% RH. In addition, after the image forming apparatus was allowed to settle for 24 hours under an environmental condition of 30° C. and 90% RH, copies of the half-tone image were produced. The image quality of the copies of the half-tone image was evaluated as follows.

Excellent: The copied half-tone image has good uniformity.

Good: The copied half-tone image has slight unevenness.

Acceptable: The copied half-tone image has unevenness.

Bad: Omissions (non image portions) are observed on the entire area of the copied half-tone image.

The evaluation results are shown in Table 4 below.

TABLE 4

| | Resin used for substrate | Carbon nanotube/carbon black ratio | Quality of half-tone image 25° C./55% RH | Quality of half-tone image 30° C./90% RH |
|---|---|---|---|---|
| Ex. 33 | Phenolic resin | 9.5/0.5 | Good | Acceptable |
| Ex. 34 | Phenolic resin | 8.5/1.5 | Good | Good |
| Ex. 35 | Phenolic resin | 7.5/2.5 | Excellent | Good |
| Ex. 36 | Phenolic resin | 6.5/3.5 | Excellent | Excellent |
| Ex. 37 | Phenolic resin | 5.0/5.0 | Excellent | Excellent |
| Ex. 38 | Phenolic resin | 3.5/6.5 | Excellent | Excellent |
| Ex. 39 | Phenolic resin | 2.5/7.5 | Excellent | Good |
| Ex. 40 | Phenolic resin | 1.5/8.5 | Excellent | Good |
| Ex. 41 | Phenolic resin | 0.5/9.5 | Good | Good |
| Ex. 42 | Epoxy resin | 5.0/5.0 | Good | Acceptable |
| Comp. Ex. 4 | Phenolic resin | 0/10.0 | Acceptable | Bad |

As mentioned above, since the photoreceptor according to an embodiment of the present invention includes an electroconductive substrate including a carbon nanotube, the substrate has a good combination of mechanical strength and electroconductivity. In addition, by adding a carbon black to the substrate in combination with a carbon nanotube, the electroconductivity of the substrate can be dramatically enhanced while maintaining the mechanical strength of the substrate. Further, since a resin is used for the substrate, emission of $CO_2$ can be dramatically reduced to about one-eighth in a case where an aluminum tube is used as a substrate.

Additional modifications and variations of the present invention are possible in light of the above teachings. It is therefore to be understood that within the scope of the appended claims the invention may be practiced other than as specifically described herein.

What is claimed is:

1. An electrophotographic photoreceptor comprising:

an electroconductive resin substrate including a resin, and an electroconductive material including a carbon black and a carbon nanotube, wherein the electroconductive resin substrate includes the carbon black and the carbon nanotube in a total amount from 20% by weight to 30% by weight based on a total weight of the electroconductive resin substrate; and a photosensitive layer located overlying the electroconductive resin substrate.

2. The electrophotographic photoreceptor according to claim 1, wherein the resin substrate includes a thermally-hardened resin.

3. The electrophotographic photoreceptor according to claim 2, wherein the thermally-hardened resin is a thermally-hardened phenolic resin.

4. The electrophotographic photoreceptor according to claim 1, wherein the carbon nanotube and the carbon black are included in the resin substrate in a weight ratio of from 9.5/0.5 to 0.5/9.5.

5. A method for producing an electrophotographic photoreceptor comprising:

forming an electroconductive resin substrate by molding a resin forming material including a carbon black and a carbon nanotube, wherein the electroconductive resin substrate includes the carbon black and the carbon nanotube in a total amount from 20% by weight to 30% by weight based on a total weight of the electroconductive resin substrate; and forming a photosensitive layer overlying the electroconductive resin substrate.

6. The method according to claim 5, wherein the resin forming material includes a thermosetting resin.

7. The method according to claim 6, wherein the thermosetting resin is a thermosetting phenolic resin.

8. The method according to claim 5, wherein the carbon nanotube and the carbon black are included in the resin forming material in a weight ratio of from 9.5/0.5 to 0.5/9.5.

* * * * *